US008215601B2

(12) United States Patent
Downs

(10) Patent No.: US 8,215,601 B2
(45) Date of Patent: Jul. 10, 2012

(54) BEVERAGE CONTAINER RECEPTACLE AND METHOD OF INSTALLING THE SAME

(75) Inventor: Kevin W. Downs, Melbourne Beach, FL (US)

(73) Assignee: Third Hand Marketing, LLC, Melbourne Beach, FL (US)

( * ) Notice: Subject to any disclaimer, the term of this patent is extended or adjusted under 35 U.S.C. 154(b) by 227 days.

(21) Appl. No.: 12/709,843

(22) Filed: Feb. 22, 2010

(65) Prior Publication Data

US 2011/0204194 A1 Aug. 25, 2011

(51) Int. Cl.
*A47K 1/09* (2006.01)

(52) U.S. Cl. ..... 248/311.2; 248/314; 248/146; 224/414; 4/300

(58) Field of Classification Search ..... 248/311.2, 248/312.1, 146, 346.11, 314, 315, 309.1; 224/414; 4/300, 301, 661
See application file for complete search history.

(56) References Cited

U.S. PATENT DOCUMENTS

| | | | | |
|---|---|---|---|---|
| 4,219,035 | A | 8/1980 | Deconinck | |
| 4,697,780 | A * | 10/1987 | Wenkman et al. | 248/558 |
| 4,998,700 | A | 3/1991 | McKaig | |
| 5,397,089 | A * | 3/1995 | Kataoka | 248/311.2 |
| 5,996,957 | A | 12/1999 | Kurtz | |
| 6,243,885 | B1 | 6/2001 | Lopez-Torres, Jr. | |
| 6,273,005 | B1 | 8/2001 | Wehrmeyer | |
| 6,527,239 | B1 | 3/2003 | Smith | |

(Continued)

FOREIGN PATENT DOCUMENTS

WO 9935946 7/1999

OTHER PUBLICATIONS

International Search Report of International Application No. PCT/US2010/062412; mailed Mar. 14, 2011; 4 pages.

(Continued)

*Primary Examiner* — Terrell McKinnon
*Assistant Examiner* — Steven Marsh
(74) *Attorney, Agent, or Firm* — Howard & Howard Attorneys PLLC

(57) ABSTRACT

A beverage container receptacle adapted for installation relative to fixed first and second structures. The receptacle includes a container-holding first part having a container rest and a periphery that defines a void in which is received a portion of the fixed first structure that extends along a first axis. The periphery at least partially surrounds the first axis, and the receptacle is supported by the first structure when it is installed relative thereto. The receptacle also includes a receptacle-retaining second part slidably positioned relative to the first part. The second part is adapted for movement relative to the first structure received in the void and toward engagement with the second structure. The receptacle is adapted for being supported against angular movement in at least one direction about the first axis through the engagement of the second part with the second structure. Also, a method for installing a beverage container receptacle including the steps of: receiving a portion of a fixed first structure having a first axis in a void defined in a first part of the receptacle and at least partially surrounding the first axis with a periphery of the void; supporting the receptacle through the first structure; slidably moving a second part of the receptacle relative to the first part toward engagement with a fixed second structure; and supporting the receptacle against rotation in at least one direction about the first axis through engagement between the second part and the second structure.

18 Claims, 5 Drawing Sheets

U.S. PATENT DOCUMENTS

| | | | | |
|---|---|---|---|---|
| 6,606,996 | B1 * | 8/2003 | Thornell et al. | 131/241 |
| 6,644,524 | B1 | 11/2003 | Garvin | |
| 6,663,068 | B2 | 12/2003 | Huang | |
| 6,843,255 | B2 * | 1/2005 | Thornell et al. | 131/241 |
| 6,869,055 | B2 | 3/2005 | Casiello Jr. | |
| 6,899,309 | B2 | 5/2005 | Smith | |
| 7,096,521 | B2 | 8/2006 | Rifkin | |
| 7,243,889 | B1 | 7/2007 | Lopez-Torres, Jr. | |
| 2001/0013144 | A1 | 8/2001 | Lopez-Torres, Jr. | |
| 2002/0162934 | A1 | 11/2002 | Dawson | |
| 2004/0149765 | A1 | 8/2004 | Pryce | |
| 2004/0177434 | A1 | 9/2004 | Sputh | |
| 2006/0143822 | A1 | 7/2006 | Kelley | |
| 2006/0231717 | A1 | 10/2006 | Coren | |
| 2006/0284040 | A1 | 12/2006 | Nixon | |
| 2008/0098514 | A1 | 5/2008 | Kelley | |

OTHER PUBLICATIONS

Written Opinion of International Searching Authority of International Application No. PCT/US2010/062412; mailed Mar. 14, 2011; 6 pages.

* cited by examiner

BEVERAGE CONTAINER RECEPTACLE AND METHOD OF INSTALLING THE SAME

BACKGROUND OF THE INVENTION

1. Field of the Invention

The present invention relates to a receptacle for holding an individual serving beverage container, such as a cup, can, bottle, etc., and more particularly to such a receptacle adapted for being mounted to a structure such as, for example, the exposed Flushometer-type flush valve and piping arrangement of a urinal or a tankless, pressurized flush toilet.

2. Description of the Related Art

It is known to mount a beverage container receptacle on the Flushometer-type flush valve and piping arrangement of a urinal. Typically, prior such receptacles merely clip onto the valve assembly or related pipes, and lack a desired level of sturdiness, which results in their supporting the beverage container in an inadequately stable manner. Additionally, prior such receptacles are typically limited to being mounted at only a single position or to only one particular component of the valve and piping arrangement. It is desirable to overcome these shortcomings found in the prior art.

SUMMARY OF THE INVENTION

The beverage container receptacle herein described is adapted for installation relative to fixed first and second structures, and provides a stable rest for securely holding a beverage container. It further facilitates its mounting on a free, horizontally projecting end portion of the fixed first structure, or on an intermediate portion extending horizontally between two unsuitable mounting locations on the fixed first structure. It is to be understood that the fixed first and second structures referred to herein may be portions of a common structure, and need only be fixed relative to each other. The fixed first structure may be, for example, the exposed valve and piping arrangement of a urinal or toilet; the fixed second structure may be, for example, the wall on which the urinal is mounted or which lies behind the toilet. Its supporting engagement with the second structure permits the receptacle to better bear the weight of the held beverage container.

The receptacle has a container-holding first part and an elongate receptacle-retaining second part, the first and second parts slidably engaged with each other. The first part includes a beverage container rest, and is provided with a void in which is received a portion of the first structure that extends along a first axis. The periphery of the void at least partially surrounds the first axis and is supported by the first structure when the receptacle is installed on the first structure. The second part is slidably positioned relative to the first part, and with the first structure portion received in the void is moveable relative to the first structure in a direction substantially perpendicular to the first axis and toward engagement with the second structure, the receptacle supported by the engaged second structure against angular movement in at least one direction about the first axis.

The present invention provides a beverage container receptacle adapted for installation relative to fixed first and second structures, the receptacle including a container-holding first part having a container rest and a periphery that defines a void in which is received a portion of the fixed first structure that extends along a first axis, the periphery at least partially surrounding the first axis, the receptacle supported by the first structure when it is installed relative to the first structure. The receptacle further includes a receptacle-retaining second part slidably positioned relative to the first part and adapted for movement relative to the first structure received in the void and toward engagement with the second structure. The receptacle is adapted for being supported against angular movement in at least one direction about the first axis through the engagement of the second part with the second structure.

The present invention also provides a method for installing a beverage container receptacle including the steps of: receiving a portion of a fixed first structure having a first axis in a void defined in a first part of the receptacle and at least partially surrounding the first axis with a periphery of the void; supporting the receptacle through the first structure; slidably moving a second part of the receptacle relative to the first part toward engagement with a fixed second structure; and supporting the receptacle against rotation in at least one direction about the first axis through engagement between the second part and the second structure.

There has thus been outlined, rather broadly, certain features of an embodiment of the invention in order that the detailed description thereof may be better understood, and in order that the present contribution to the art may be better appreciated. Additional or alternative features of an embodiment of the invention are described in further detail below.

In this respect, before explaining an embodiment of the invention in detail, it is to be understood that the invention is not limited in its application to the details of construction and to the arrangement of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

BRIEF DESCRIPTION OF THE DRAWINGS

To accomplish the above and related objects, the invention may be embodied in the form illustrated in the accompanying drawings, attention being called to the fact, however, that the drawings are illustrative only, and that changes may be made in the specific constructions illustrated. Moreover, it is to be noted that the accompanying drawings are not necessarily drawn to scale or to the same scale. In particular, the scale of some of the elements of the drawings may be exaggerated to emphasize characteristics of the elements.

Various other objects, features and attendant advantages of the present invention will become fully appreciated as the same becomes better understood when considered in conjunction with the accompanying drawings, in which like reference characters designate the same, similar or corresponding parts throughout the several views, wherein.

Figure 1:
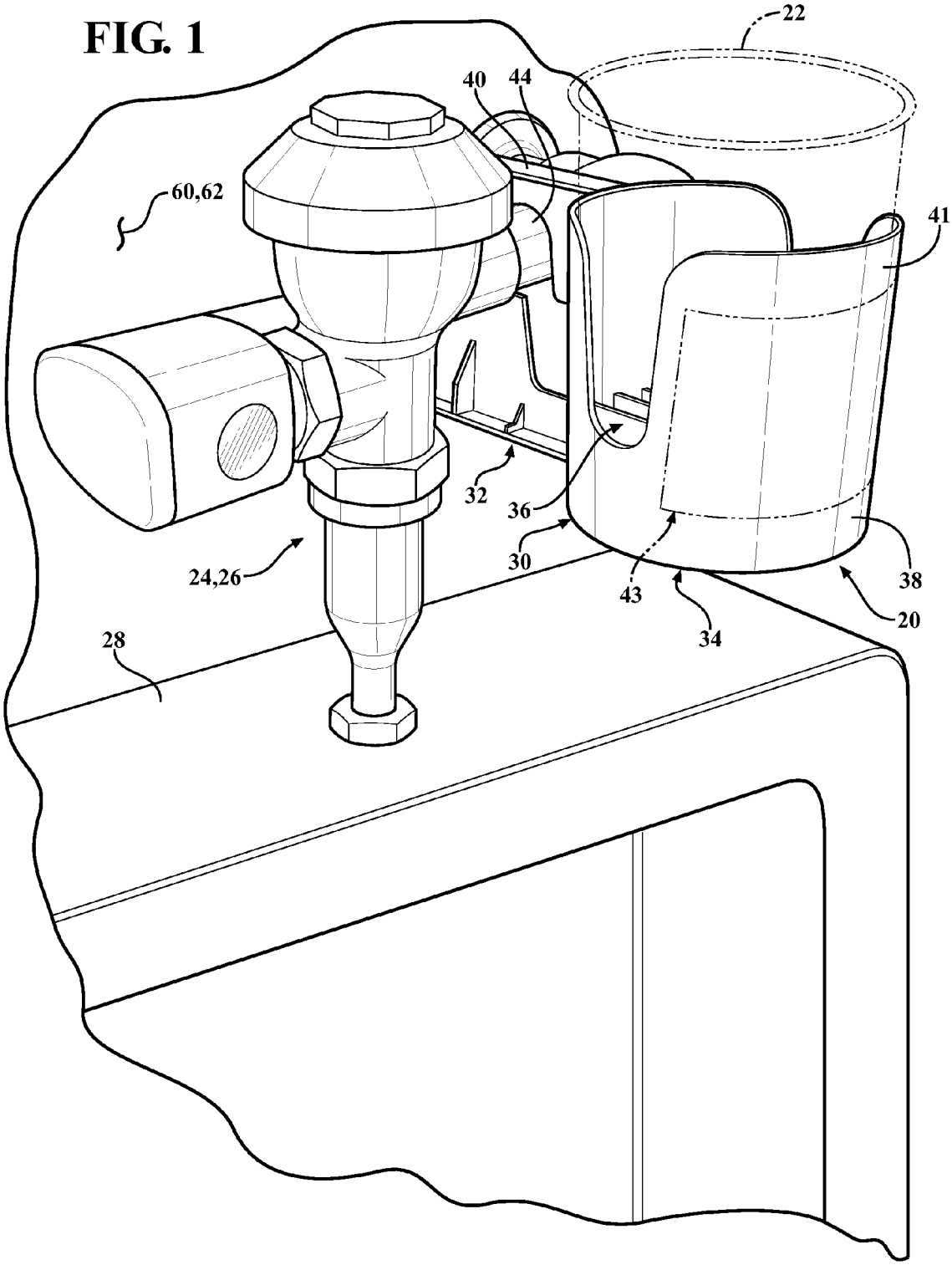
FIG. 1 is a fragmented perspective front view of an embodiment of a beverage container receptacle installed onto on the valve and piping arrangement of a urinal that is mounted to a vertical wall.

The invention is susceptible to various modifications and alternative forms, and the specific embodiment thereof shown by way of example in the drawings is herein described in detail. It should be understood, however, that the drawings and detailed description are not intended to limit the invention to the particular form disclosed, but on the contrary, the intention is to cover all modifications, equivalents and alternatives falling within the spirit and scope of the present invention as defined by the appended claims.

DETAILED DESCRIPTION

FIG. 1 shows an embodiment of a beverage container receptacle 20 that supports beverage container 22 (shown in phantom lines) and which is mounted to a fixed first structure 24, which may be the valve and piping arrangement 26 of a urinal 28. The arrangement 26 is in common use and its valve is generally known as a Flushometer-type flush valve. Arrangement 26 is also in common use on tankless, pressurized flush toilets, on which receptacle may also be utilized. Receptacle 20 may be an injection molded plastic design of two interengaged parts, including a container-holding first part 30 and a receptacle-retaining second part 32 which slidably cooperate.

Figure 3:
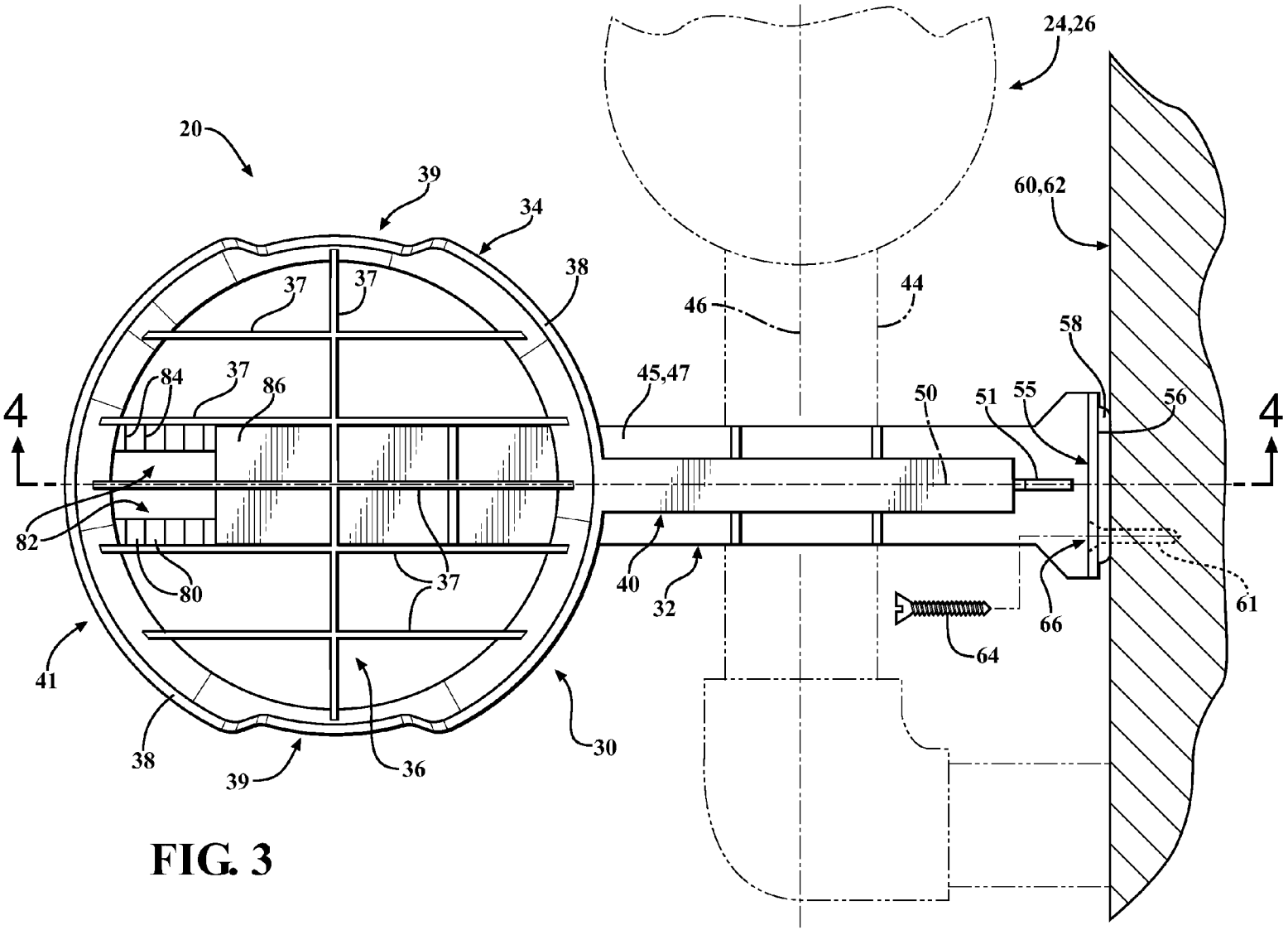
FIG. 3 is a plan view of the installed receptacle shown in FIG. 1, with the valve and piping arrangement shown in phantom lines.
Figure 4:
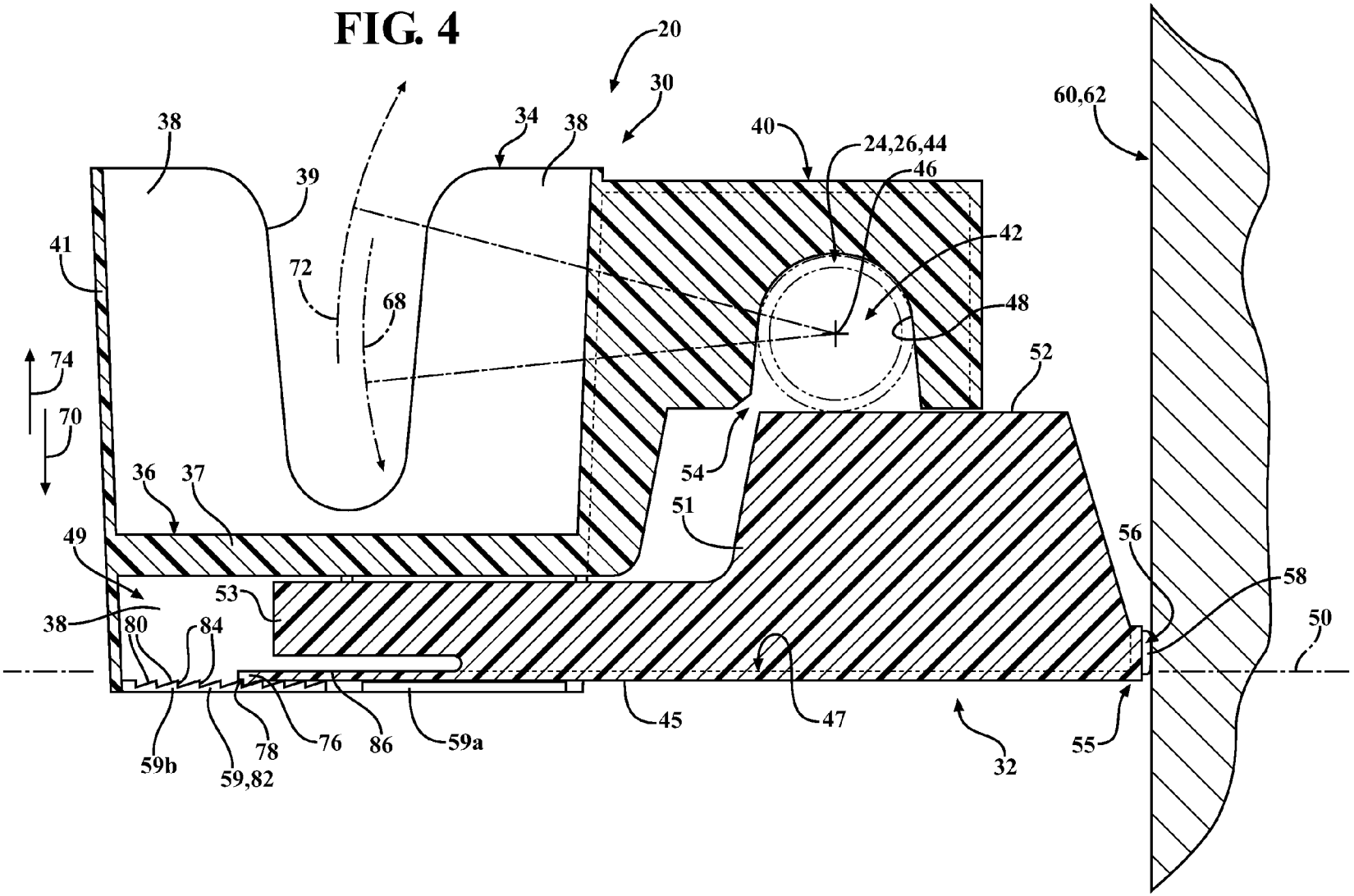
FIG. 4 is a sectional view of the installed receptacle along line 4-4 of FIG. 3.

The first part 30 includes integrally-formed portions that define a container holder 34 and a structure hook 40. As best shown in FIGS. 3 and 4, the container holder 34 includes a generally circular beverage container rest 36 defined by the coplanar upper edges of a plurality of spaced, integrally-formed, horizontally extending beams 37, and a substantially cylindrical beverage container containing wall 38 that surrounds the beverage container rest 36. The containing wall 38 is provided with a pair of diametrically-opposed, open-ended slots 39 that extend upwardly from about the level of container rest 36. The side edges of each slot 39 diverge slightly such that the slot 39 is widest near the top of containing wall 38, and if container 22 is a mug, accommodates its handle. The opposed pair of slots 39 may also accommodate the thumb and fingers of a user in placing or removing container 22 relative to receptacle 20. As shown in FIG. 1, the outer front surface 41 of containing wall 38 also provides a space 43 for placement of an advertisement or other notice or image.

The structure hook 40 defines an open-ended slot or void 42 that is open on the bottom, and into which is received a horizontally-extending portion 44 of the exposed valve or piping arrangement 26 that defines fixed first structure 24. The first structure portion 44 may, for example, be a horizontally-projecting portion of the flush valve or a horizontally-extending length of pipe. After being placed over first structure portion 44, the structure hook 40 surrounds its horizontally-extending first axis 46 on three sides (top, front and rear). In other words, the periphery 48 of open-ended slot or void 42 at least partially surrounds the substantially horizontal axis 46 of first structure portion 44 and, as best shown in FIG. 4, is in contact with the first structure 24. The contact between void periphery 48 and the first structure portion 44 disposed in void 42 supports receptacle 20 through the valve and piping arrangement 26. Hook 40 is elongate and extends radially, relative to circular container rest 36, from the rear surface of containing wall 38.

Figure 2:
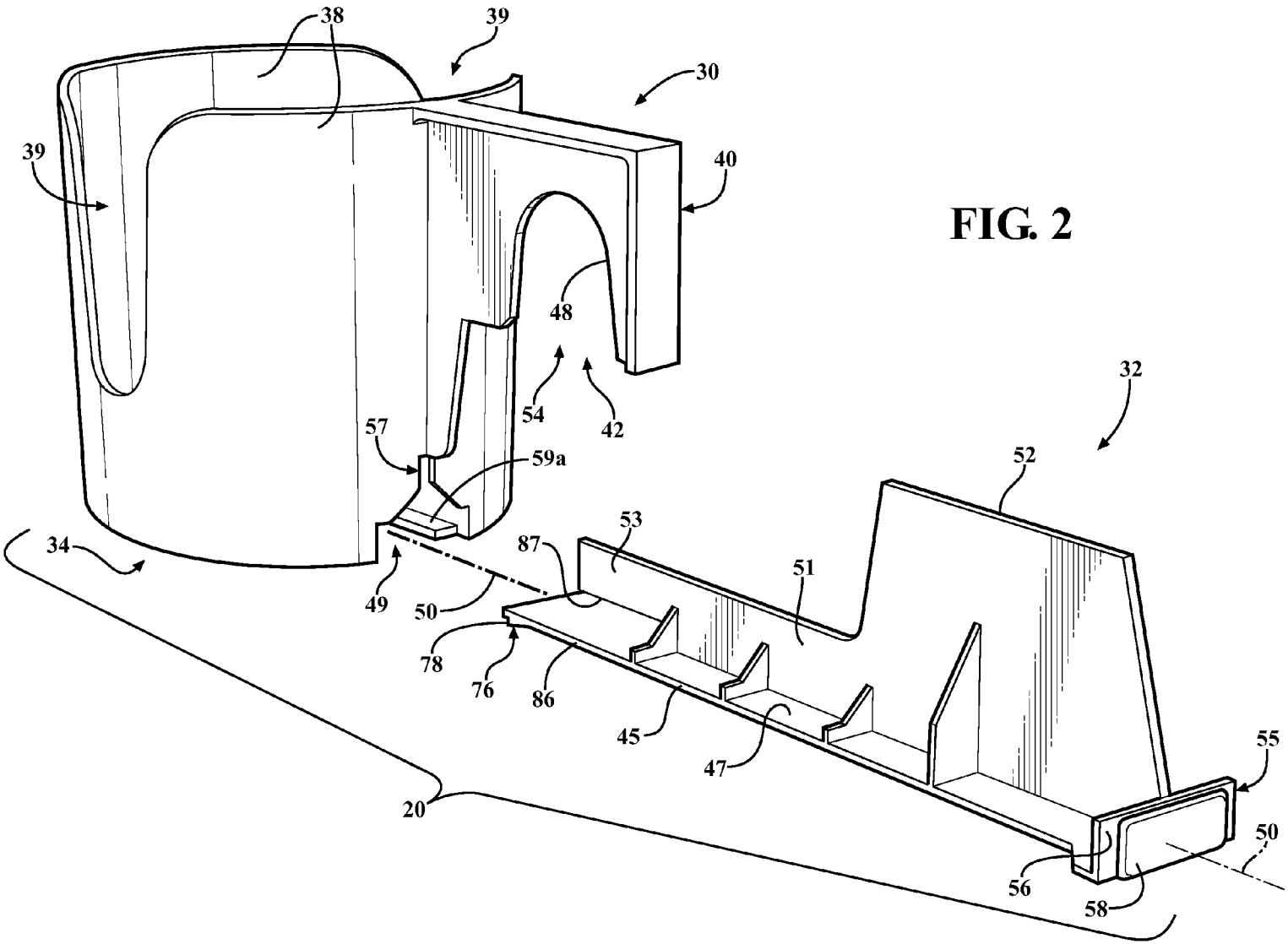
FIG. 2 is an exploded view of the first and second parts of the receptacle shown in FIG. 1.
Figure 5:
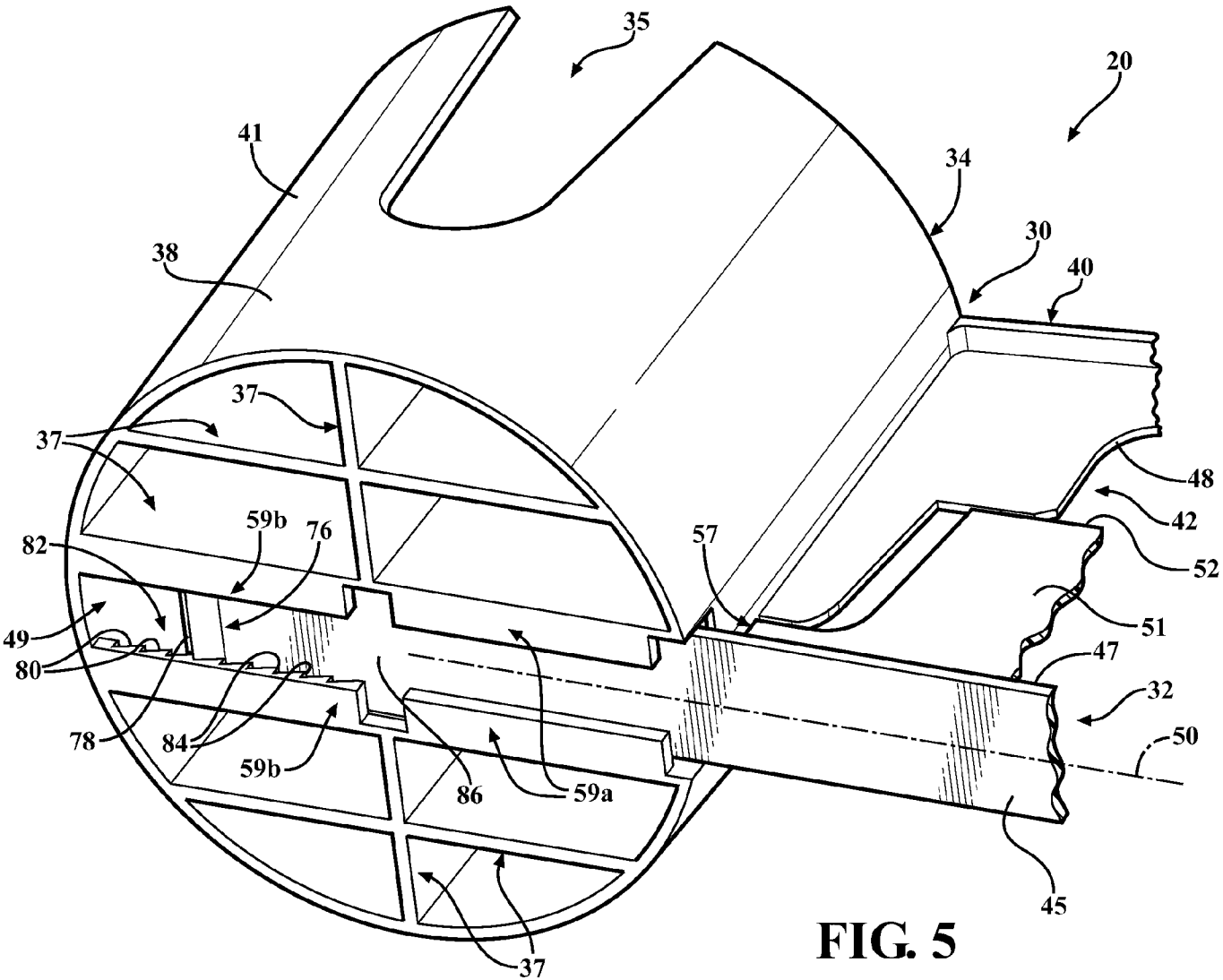
FIG. 5 is a fragmented, bottom perspective view of the receptacle shown in FIG. 1.

Referring to FIGS. 2, 4, and 5, the elongate second part 32 is received in recess 49 located in first part 30 below container rest 36, and is slidably positioned relative to the first part 30 in a direction that is substantially along the horizontal, longitudinal second axis 50 of the second part 32, and substantially perpendicular to first axis 46. The elongate second part 32 and elongate hook 40 are superposed and extend substantially in parallel, with the hook 40 located vertically above the second part 32.

The second part 32 includes elongate, horizontally planar cross-flange 45 having an upper side 47 to which is integrally connected upstanding flange 51. Flange 51 defines upper top edge 52 that extends substantially across the open, bottom end 54 of the open-ended slot 42 of the structure hook 40. Thus, upper top edge 52 and void periphery 48 together radially enclose or contain the horizontally-extending structure portion 44. Upper top edge 52 is substantially straight and parallel with second axis 50 of second part 32, and is substantially horizontal when receptacle 20 is in its installed state.

Upstanding flange 51 also defines a planar blade portion 53 that is received in recess 49, vertically-extending blade portion 53 disposed between the side edges of a vertically-extending, open-ended slot 57 in the rear of containing wall 38, the open bottom end of slot 57 communicating with elongate recess 49, as best shown in FIG. 2. The first and second parts 30, 32 are stabilized against substantial relative rotation or rocking motion generally about second axis 50 by abutting engagement between the opposed planar sides of blade portion 53 and the respectively adjacent side edge of slot 57. The bottommost portion of elongate recess 49 is partially defined by opposed pairs of elongate, centrally inwardly extending flanges 59 that are integrally formed on first part 30. The elongate centrally inward edges of each opposed pair of flanges 59 interface each other. Referring to FIG. 5, the upper sides of the first pair of flanges **59*a* slidably engage the laterally outboard portions of the planar bottom surface of cross-flange 45. The first and second parts 30, 32 are further stabilized against relative rotation or rocking motion generally about second axis 50 by the interfacing engagement between flanges 59*a* and cross-flange 45. The upper sides of the second pair of flanges 59*b* define rack 82** discussed further herein below.

First and second parts 30, 32 may be pre-assembled together prior to installation of receptacle 20 onto first structure 24 if structure hook 40 of first part 30 is to be received laterally onto horizontally-extending portion 44 of first structure 24, i.e., if void 42 is received about valve or piping arrangement 26 from a direction substantially along axis 46, rather than from a direction substantially perpendicular to axis 46. Such may be the case where receptacle 20 is received onto a projecting free end of the horizontally-extending portion 44 of the valve and piping arrangement 26.

Alternatively, if structure hook 40 of first part 30 is to be received directly onto horizontally-extending portion 44 of first structure 24 in a straddling manner, i.e., if void 42 is received about valve or piping arrangement 26 through its open bottom 54 or in direction substantially perpendicular to axis 46, then the first and second parts 30, 32 may be assembled together subsequent to structure portion 44 being received in void 42. Such may be the case where receptacle 20 is positioned on a length of pipe (as seen in FIGS. 1 and 3) that extends between the flush valve and an elbow of arrangement 26, for example, each of which may be an unsuitable receptacle mounting location.

The second part 32 has an integrally-formed foot 55 located at its axial end opposite that which includes blade portion 53. Foot 55 defines end surface 56 that is substantially planar and normal to longitudinal axis 50. The planar surface 56 is located low on second part 32, approximately at the level of cross-flange 45. Surface 56 may be provided with an adhesive pad 58, such as double-sided foam tape, affixed thereto. When the first and second parts 30, 32 are interengaged, with blade portion 53 disposed in recess 49, the first part 30 of receptacle 20 is brought into its desired installed position relative to first structure 24 (in which first structure portion 44 is in void 42 and container rest 36 is substantially horizontal), and the second part 32 is withdrawn from recess 49 and moved, relative to structure 24 and first part 30, in a direction along second axis 50 and away from first part 30 until foot 55 (or, if present, adhesive pad 58 affixed to planar surface 56) abuts a second fixed structure 60. Second fixed structure 60 may be the vertical wall 62 on which urinal 28 is mounted or which lies behind the toilet to which valve or piping arrangement 26 is attached, wall 62 located behind arrangement 26.

In a preferred installation, the second structure 60 is substantially parallel with the horizontally-extending first structure portion 44; i.e., vertical wall 62 is substantially parallel with first axis 46. Once receptacle 20 is positioned in its installed orientation, foot 55 of the second part 32 is preferably then affixed to wall 62. Foot 55 may be affixed to wall 62 via adhesive pad 58 on surface 56 or, alternatively, by other fastening means such as, for example, a screw 64 that is inserted through a clearance hole 66 in foot 55 and threaded into a receiving hole or screw anchor 61 in wall 62, as shown in FIG. 3. With foot 55 of second part 32 thus secured to wall 62, installed receptacle 20 is retained in place and prevented from rotating upwardly about first axis 46 in the direction of arrow 74 shown in FIG. 4 (i.e., such that container rest 36 would move upwardly) and from moving laterally (i.e., along first axis 46).

Relative movement of the slidably attached first 30 and second 32 parts away from each other in a direction along second axis 50 during installation of receptacle 20 is facilitated by the sliding engagement of a shoulder 76 formed near the terminal end of cross-flange 45 of second part 32 and having a vertical abutment surface 78 that lies in a plane substantially normal to second axis 50, over a series of ramped sliding surfaces 80 of the sawtooth-profiled rack 82 formed on the upper surfaces of the second pair of flanges 59*b*, with the rack 82 extending along second axis 50.

Each ramped sliding surface 80 of rack 82 terminates at a vertical abutment surface 84 that lies in a plane substantially normal to second axis 50. Rack 82 thus includes two parallel series of individual teeth 85, each formed on one of flanges 59*b*. Each tooth 85 is defined by a ramped sliding surface 80 and a vertical abutment surface 84. Each series of teeth is linearly arranged in a direction parallel with second axis 50 in a sawtooth fashion. Once foot 55 reaches its installed position relative to wall 62, with receptacle 20 in its desired, installed orientation (in which beverage container rests 36 is preferably substantially horizontal), relative movement of the first 30 and second 32 parts toward each other is impeded by the abutting contact of planar vertical abutment surface 78 of shoulder 76 with the adjacent interfacing planar vertical abutment surfaces 84 of rack 82. That is to say, expansion of the receptacle 20 into its installed state is facilitated by relatively moving the slidably engaged first and second parts 30, 32 away from each other; while support against its contraction is provided by the abutting superposition of vertical abutment surfaces 78, 84.

Foot 55 is spaced an appreciable distance from upper top edge 52, and thus the location of foot 55, once affixed to wall 62, is vertically well-below horizontal first axis 46, such that receptacle 20 and any container 22 supported thereby is supported against downward movement in the direction of arrow 70 shown in FIG. 4 by the second structure 60. With continued reference to FIG. 4, those of ordinary skill in the art will recognize that a first counterclockwise-directed moment 68 on receptacle 20 about first axis 46, induced by the weight of the container holder 34 and any container 22 supported by its container rest 36, is counteracted by an equal and opposing second clockwise moment 72 on receptacle 20 about axis 46. The counteracting second moment 72 results from compression of the second part 32 between wall 62 and the first part 30. Thus, the orientation of the installed receptacle 20 is maintained, and it is prevented from rotating downwardly (i.e., such that container rest 36 would move in the direction of arrow 70) about the horizontally-extending structure portion 44. In other words, the supporting engagement of the second part 32 with the second structure 60 (e.g., the abutment between foot 55 and wall 62) at a location below axis 46 of the horizontally-extending first structure portion 44, and between the first and second parts 30, 32 (e.g., the abutment of shoulder abutment surface 78 and a rack abutment surface 84), supports the receptacle 20 against downward rotation about the valve and piping arrangement 26 of urinal 28.

In the depicted embodiment, first part 30 carries rack 82, and second part 32 carries shoulder 76, but it is to be understood that the converse arrangement may instead be adopted.

In the depicted embodiment, shoulder 76 is formed at the terminal end of finger 86, which is a continuation of cross-flange 45. Finger 86 is not, however, integrally connected to upstanding flange 51, and thus finger 86 can be deflected vertically to move shoulder 76 from a fully engaging position in which abutment surfaces 78, 84 are maximally interfaced, to a fully disengaging position in which abutment surfaces 78, 84 do not overlappingly interface. Finger 86 is disposed beneath blade portion 53 of flange 51, and is spaced from lower edge 87 thereof. During expansion of receptacle 20, as first and second parts 30, 32 are relatively moved away from each other along second axis 50, finger 86 is resiliently deflected away from rack 82 and towards blade portion lower edge 87 as shoulder 76 is moved along ramped sliding surfaces 80 of rack 82. It is to be understood, however, that receptacle 20 may be modified to alternatively employ the converse arrangement, in shoulder 76 is rigidly position, and rack 82 is elastically deflected from a fully engaging position to a fully disengaging position. Interengaged first and second parts 30, 32 are thus capable of unconstrained relative sliding movement away from each other, and are normally constrained against relative sliding movement toward each other, for they are incapable of substantial relative sliding movement towards each other in the fully engaging position of shoulder 76 (or rack 82 if receptacle 20 is alternatively so configured).

As discussed above, once installed, relative movement of the first and second parts 30, 32 toward each other along the longitudinal axis 50 is prevented by the abutting engagement of vertical planar abutment surface 78 of shoulder 76, and the adjacent, superposed, vertical planar abutment surface 84 of rack 82. However, in the depicted embodiment finger 86 may be manually deflected away from rack 82 by pushing it towards blade portion lower edge 87 and holding the shoulder 76 in a fully disengaging position should it be desired to contract receptacle 20, and thus move the slidably engaged first and second parts 30, 32 relatively towards each other. Such contraction may be desired, for example, for assembly of the first and second parts 30, 32 together during installation of receptacle 20 subsequent to the intermediately-positioned, horizontally-extending portion 44 of first structure 24 being received into void 42 through its open bottom end 54, as described above.

As to a further discussion of the manner of usage and operation of the present invention, the same should be apparent from the above description. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A beverage container receptacle adapted for installation relative to fixed first and second structures, said receptacle comprising:

a container-holding first part having a container rest and a periphery that defines a void in which is received a portion of the fixed first structure that extends along a first axis, said periphery at least partially surrounding the first axis, said receptacle supported by the first structure when it is installed relative to the first structure; and a receptacle-retaining second part slidably positioned relative to said first part and adapted for movement relative to the first structure received in said void and toward engagement with the second structure;

said receptacle adapted for being supported against angular movement in at least one direction about the first axis through the engagement of said second part with the second structure; and wherein said void has an opening, and said second part comprises an edge that substantially extends across said opening, the portion of the first structure received in said void when said receptacle is installed relative to the first structure substantially surrounded by said periphery and said edge, whereby said receptacle is retained to the first structure.

2. The beverage container receptacle of claim 1, wherein said first and second parts are capable of unconstrained relative sliding movement away from each other, and are constrained against relative sliding movement toward each other.

3. The beverage container receptacle of claim 2, wherein relative sliding movement between said first and second parts is along a second axis, said second axis substantially perpendicular to the first axis when said receptacle is installed relative to the first structure.

4. The beverage container receptacle of claim 2, wherein said first and second parts have relative sliding movement along a second axis;

one of said first and second parts comprises a rack including a series of teeth linearly arranged in a direction substantially parallel with said second axis, each tooth of said series defined by a sliding surface and an abutment surface; and the other of said first and second parts comprises a shoulder having an abutment surface;

relative movement of said first and second parts away from each other including sliding engagement between said shoulder and at least one said sliding surface;

relative movement of said first and second parts toward each other impeded by abutting superposition of interfacing rack and shoulder abutment surfaces.

5. The beverage container receptacle of claim 4, wherein one of said rack and said shoulder is elastically deflectable from a fully engaging position in which said abutment surfaces are interfaced, to a fully disengaging position in which said abutment surfaces do not overlappingly interface.

6. The beverage container receptacle of claim 5, wherein said first and second parts are incapable of substantial relative sliding movement towards each other in said fully engaging position.

7. The beverage container receptacle of claim 1, wherein said second part comprises a foot adapted for affixation to the second structure when said second part and the second structure are engaged.

8. The beverage container receptacle of claim 7, wherein said receptacle is adapted for being supported against angular movement in both directions about the first axis through the engagement and affixation between said second part and the second structure.

9. The beverage container receptacle of claim 1, wherein the first structure is a flush valve and piping arrangement attached to one of a urinal and a toilet, and the second structure is a wall located behind the flush valve and piping arrangement.

10. The beverage container receptacle of claim 1, wherein said second part is adapted for movement relative to the first part and toward engagement with the second structure when said receptacle is installed relative to the first structure.

11. A method for installing a beverage container receptacle comprising the steps of:

receiving a portion of a fixed first structure having a first axis in a void defined in a first part of the receptacle and at least partially surrounding the first axis with a periphery of the void;

supporting the receptacle with the first structure;

placing an edge of a second part in a position adjacent to the portion of the first structure received in the void;

substantially surrounding the first structure portion with the void periphery and the edge, whereby the installed receptacle is retained to the first structure;

slidably moving the second part of the receptacle relative to the first part toward engagement with a fixed second structure; and supporting the receptacle against rotation in at least one of two opposite directions about the first axis through engagement between the second part and the second structure.

12. The method of claim 11, further comprising the step of assembling the first and second parts together subsequent to said step of receiving a portion of a fixed first structure in a void.

13. The method of claim 11, further comprising the step of affixing the second part to the engaged second structure, thereby supporting the receptacle against rotation in both directions about the first axis.

14. The method of claim 13, wherein said step of affixing includes adhering a foot of the second part to the second structure.

15. The method of claim 13, wherein said step of affixing includes driving a screw through a foot of the second part and into the second structure.

16. The method of claim 11, wherein said step of receiving a portion of a fixed first structure in a void comprises receiving a portion of a flush valve and piping arrangement in the void; and said step of slidably moving a second part toward engagement with a fixed second structure comprises moving the second part towards engagement with a wall located behind the flush valve and piping arrangement.

17. The method of claim 11, further comprising the step of moving the second part relative to the first structure toward engagement with the fixed second structure.

18. The method of claim 17, wherein the steps of slidably moving the second part relative to the first part and moving the second part relative to the first structure are performed simultaneously.

* * * * *